US007438032B2

(12) United States Patent
Herold et al.

(10) Patent No.: US 7,438,032 B2
(45) Date of Patent: Oct. 21, 2008

(54) METHOD AND DEVICE FOR CONTROLLING AN INTERNAL COMBUSTION ENGINE

(75) Inventors: Frank Herold, Grosspostwitz (DE); Thomas Knorr, Tegemheim (DE); Frank Weiss, Pentling/Grasslfing (DE)

(73) Assignee: Siemens Aktiengesellschaft, Munich (DE)

( * ) Notice: Subject to any disclaimer, the term of this patent is extended or adjusted under 35 U.S.C. 154(b) by 220 days.

(21) Appl. No.: 10/592,588

(22) PCT Filed: Mar. 15, 2005

(86) PCT No.: PCT/EP2005/051171

§ 371 (c)(1),
(2), (4) Date: Sep. 12, 2006

(87) PCT Pub. No.: WO2005/090766

PCT Pub. Date: Sep. 29, 2005

(65) Prior Publication Data

US 2007/0186888 A1 Aug. 16, 2007

(30) Foreign Application Priority Data

Mar. 15, 2004 (DE) ..... 10 2004 012 756

(51) Int. Cl.
*F01L 1/34* (2006.01)

(52) U.S. Cl. ..... 123/90.16; 123/90.11; 123/90.31; 123/90.44; 74/569; 73/114.61; 701/105

(58) Field of Classification Search ..... 123/90.11, 123/90.15, 90.16, 90.17, 90.18, 90.27, 90.31, 123/90.44, 90.6; 74/567, 569; 73/114.61, 73/114.63, 114.79; 701/101, 105
See application file for complete search history.

(56) References Cited

U.S. PATENT DOCUMENTS 6,135,078 A * 10/2000 Doi et al. ..... 123/90.18
6,357,404 B1 3/2002 Deeg

FOREIGN PATENT DOCUMENTS

| | | | |
|---|---|---|---|
| DE | 40 28 442 | A1 | 3/1992 |
| DE | 196 06 054 | C2 | 8/1997 |
| DE | 101 48 177 | A1 | 4/2003 |
| DE | 101 48 178 | A1 | 4/2003 |
| EP | 0 798 451 | A1 | 10/1997 |

* cited by examiner

*Primary Examiner*—Ching Chang
(74) *Attorney, Agent, or Firm*—Bell, Boyd & Lloyd LLP

(57) ABSTRACT

The invention relates to an internal combustion engine comprising an inlet tract, leading to the inlet to a cylinder where a gas inlet valve is arranged. A valve drive for the gas inlet valve is provided, by means of which the valve stroke of the gas inlet may be adjusted using an actuator element, which permits differing cams to operate the gas inlet valve. An inductive actuator drive is arranged on the actuator element in which a voltage is induced during a switching process. A first unit is embodied for recognition of whether a switching of the valve stroke has occurred by means of the voltage induced in the inductive actuator drive which is characteristic of the switching process. A second unit is embodied for the control of at least one further actuator body depending on whether a switching of the valve is recognized in the first switching unit.

17 Claims, 4 Drawing Sheets

METHOD AND DEVICE FOR CONTROLLING AN INTERNAL COMBUSTION ENGINE

CROSS REFERENCE TO RELATED APPLICATIONS

This application is the US National Stage of International Application No. PCT/EP2005/051171, filed Mar. 15, 2005 and claims the benefit thereof. The International Application claims the benefits of German Patent application No. 10 2004 012 756.5 filed Mar. 15, 2004. All of the applications are incorporated by reference herein in their entirety.

FIELD OF THE INVENTION

The invention relates to a method and device for controlling an internal combustion engine.

BACKGROUND OF THE INVENTION

The requirements relating to the output and efficiency of internal combustion engines are become increasingly stringent. At the same time strict legal provisions require emissions to be kept at low levels. Such requirements can be easily satisfied, if the internal combustion engine is fitted with gas exchange valves and corresponding drives for these, with different valve lift characteristics as a function of the working point of the internal combustion engine. This allows throttle losses to be reduced as air is taken in and optionally allows high exhaust gas recirculation rates to be rapidly set.

It is known that the valve lift of a gas inlet valve in the internal combustion engine can be adjusted between a low and high valve lift. For example the Porsche 911 Turbo is fitted with a device for adjusting the valve lift of the gas inlet valve and the gas outlet valve. The internal combustion engine of the said vehicle is also provided with a camshaft, on which a cam with a low lift and two further cams with a higher lift are configured for each gas inlet valve. The cam lift is transmitted to the gas inlet valve by means of a transformer unit. The transformer unit is configured as a bucket tappet, comprising a cylinder element and an annular cylinder element disposed concentrically in relation to it. The cam with a low lift acts on the cylinder element, while the cams with the higher lift act on the annular cylinder element. As a function of the position of the bucket tappet, either the low or higher lift is transmitted to the gas inlet valve. During no-load operation of the internal combustion engine, the low cam lift is transmitted to the gas inlet valve. This results in reduced frictional losses due to the small diameter of the cam used in this operating state and the cylinder element and the lower valve lift.

A higher charge movement is also achieved. This enables the emissions of the internal combustion engine to be reduced and fuel consumption to be kept low at the same time. The low valve lift is maintained at low and medium load. If the load requirements imposed on the internal combustion engine are high, a switch is made to the higher valve lift.

If an intended switch of the valve lift actually fails to take place and this is not identified, it results in an increase in pollutant emissions in the respective cylinder during the combustion process.

SUMMARY OF THE INVENTION

The object of the invention is to create a method and device for controlling an internal combustion engine, which enable low levels of pollutant emissions to be achieved during operation of the internal combustion engine.

The object is achieved by the features of the independent claims. Advantageous embodiments of the invention are characterized in the subclaims.

According to a first aspect, the invention is characterized by a device for controlling an internal combustion engine, with an intake pipe, which leads to an inlet of a cylinder, on which a gas inlet valve is disposed. A valve drive for the gas inlet valve is also assigned to the internal combustion engine, by means of which the valve lift of the gas inlet valve can be adjusted by means of an actuator element, by means of which different cams can be made to act on the gas inlet valve. An inductive actuator drive acts on the actuator element, a voltage being induced in said inductive actuator drive during the course of a switching process. The device comprises a first unit, which is configured to identify whether switching of the valve lift has taken place based on the induced voltage in the inductive actuator drive, which is characteristic of the switching process. It also comprises a second unit, which is configured to control at least one further actuator body, as a function of whether switching has been identified in the first unit.

According to a further aspect, the invention is characterized by a method for controlling the internal combustion engine, wherein switching of the valve lift is identified based on the induced voltage in the inductive actuator drive, which is characteristic of the switching process, and wherein at least one actuator body is activated as a function of whether switching has been identified.

The invention therefore utilizes the knowledge that during the course of a switching process the voltage, which is characteristic of the switching process, is induced in the inductive actuator drive. According to the invention, in addition to its own actual function as a drive unit, the inductive actuator drive is also used as a sensor, thus allowing simple identification of whether a switching process has actually taken place. This identification also takes place so close in time to the actual occurrence or otherwise of the switching process that at least one actuator body can quickly be accessed, for example an injection valve or a spark plug, even before the power lift of the respective cylinder, which directly follows the required switching of the valve lift.

According to one advantageous embodiment of the invention, the first unit is configured to verify whether the induced voltage characteristic of the switching process occurs in the inductive actuator drive within a predetermined camshaft angle range.

This has the advantage that the verification of whether the characteristic induced voltage occurs only has to take place within a predetermined time window, corresponding to the predetermined camshaft angle range, and less computing outlay is therefore required. It is also possible to identify even more precisely whether the required switching process of the valve lift has actually taken place, as voltage fluctuations that may occur outside the predetermined camshaft angle range cannot be identified erroneously as the characteristic induced voltage.

According to a further advantageous embodiment of the invention, the first unit has a measuring unit, which is configured to measure a voltage drop over the inductive actuator drive in relation to a supply potential of the inductive actuator drive. This has the advantage that fluctuations in the supply potential do not influence the quality of measurement of the voltage drop. This is an important advantage with regard to controlling an internal combustion engine, as the supply potential of a voltage supply for a motor vehicle, in which the internal combustion engine can be disposed, is regularly subject to major fluctuations and the characteristic induced voltage in some instances only has a small potential difference of for example 0.7 V.

According to a further advantageous embodiment of the invention, the first unit has a conversion unit, which is configured to convert the voltage drop over the inductive actuator drive, as detected by the measuring unit, to a corresponding voltage drop in relation to a reference potential, which can also be referred to as ground potential, of an evaluation unit. This allows simple evaluation of the voltage drop detected by the measuring unit in the evaluation unit. This is particularly advantageous, when the evaluation unit is configured as a microcontroller, the inputs of which are generally related to the reference potential.

According to a further advantageous embodiment of the invention, the measuring unit is assigned a resistor, which can be connected by means of a switch parallel to the inductive actuator drive. This means that the voltage drop at the inductive actuator drive can be measured in a particularly simple manner.

According to a further advantageous embodiment of the invention, the measuring unit is configured to detect the voltage drop over a number of inductive actuator drives. This has the advantage that the voltage drop over a number of inductive actuator drives can thus be detected in a more economical manner and no multiplexer is required.

According to a further advantageous embodiment of the invention, the measuring unit has a buffer for the detected voltage drop. This has the advantage, particularly in respect of a characteristic induced voltage that only occurs for a very short time, that correspondingly detected measured values can also be read into the evaluation unit at a different time.

BRIEF DESCRIPTION OF THE DRAWINGS

Exemplary embodiments of the invention are described in more detail below with reference to the schematic drawings, in which:

FIG. 2 shows a further view of parts of the internal combustion engine according to

FIG. 1,

Elements with the same structure or function are marked with the same reference characters in all the figures.

DETAILED DESCRIPTION OF THE INVENTION

Figure 1:
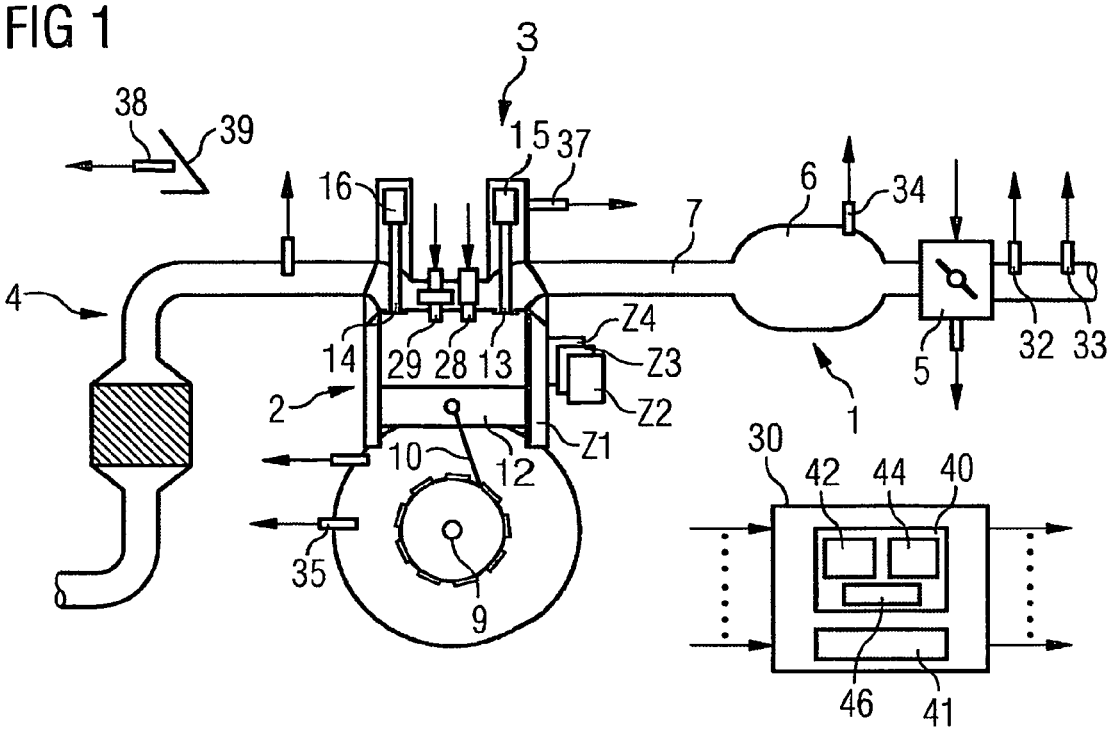
FIG. 1 shows an internal combustion engine with a controller.
Figure 2:
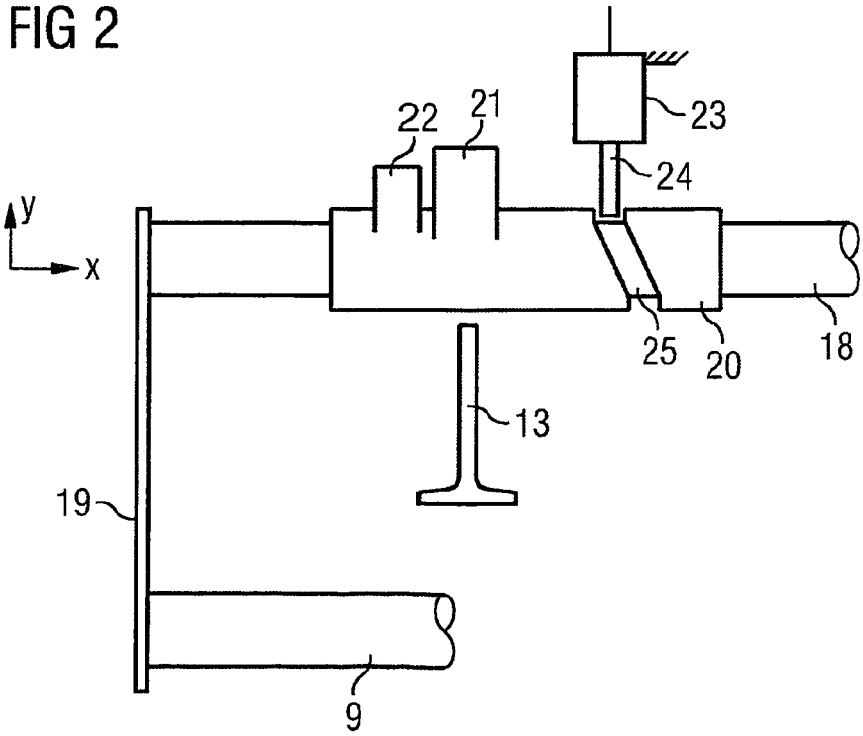

An internal combustion engine (FIG. 1) has an intake tract 1, an engine block 2, a cylinder head 3 and an exhaust gas tract 4. The intake tract 1 preferably has a throttle valve 5, a manifold 6 and an intake pipe 7, which leads to a cylinder Z1 via an inlet duct into the engine block 2.

The engine block 2 also has a crankshaft 9, which is coupled via a connecting rod 10 to a piston 12 of the cylinder Z1.

The cylinder head 3 has a valve drive with a gas inlet valve 13 and a gas outlet valve 14 and valve drives 15, 16 assigned to these. The valve drives 15, 16 comprise a camshaft 18, which is coupled by means of a coupling mechanism 19 to the crankshaft 9. The phase angle between the crankshaft 9 and the camshaft 18 can be specified beforehand. It can however also be adjustable.

An actuator element 20 is coupled mechanically to the camshaft 18. The actuator element 20 preferably comprises a first cam 21 and a second cam 22. The first and second cams 21, 22 have different cam lifts. They can however also generally have different cam characteristics.

An inductive actuator drive 23 can be made to act on the actuator element 20 and thus brings about an adjustment of the actuator element 20 in the axis marked X. The inductive actuator drive has a pin 24, which can be moved in the direction of the actuator element 20 by corresponding energizing of the inductive actuator drive 23 in the axis marked Y. The actuator element 20 has a groove 25, into which the pin 24 can be inserted. If the pin 24 is located in the groove 25 during rotation of the camshaft 18, the actuator element 20 is displaced in an axial direction in relation to the camshaft 18, i.e. in the direction of the axis marked X.

Figure 3A:
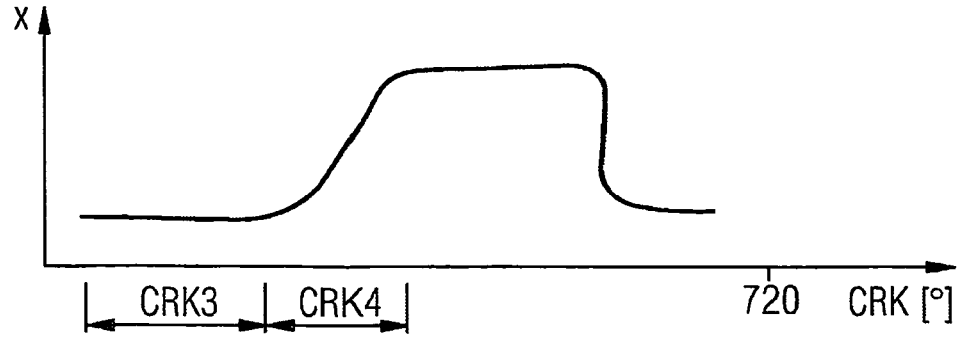
FIGS. 3*a* and 3*b* show characteristics of a groove of an actuator element plotted over the crankshaft angle.
Figure 3B:
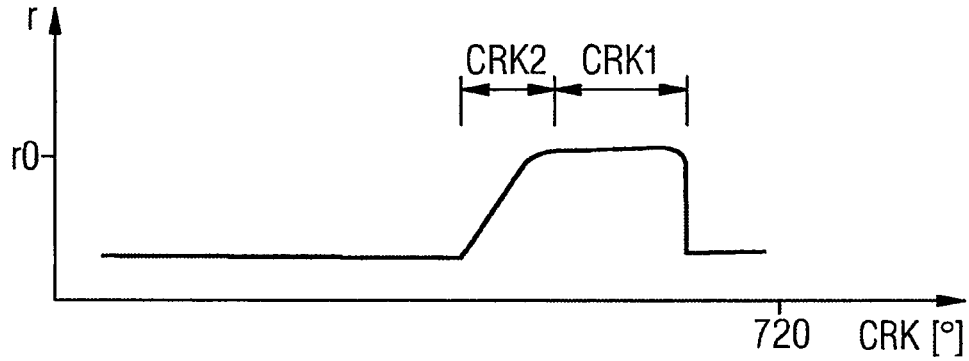

The characteristics of the groove 25 in the direction marked X are shown in relation to the crankshaft angle CRK with reference to FIG. 3*a*. The characteristics of the groove in a radial direction r are shown in relation to the axis marked Y with respect to the crankshaft angle CRK with reference to FIG. 3*b*. The groove only extends in a radial direction r over a sub-area of the periphery of the actuator element 20. The basic circle of the actuator element 20 is thereby marked r0. The groove 25 is thus not configured in a first crankshaft angle range CRK1. Its depth decreases in a radial direction in a crankshaft angle range CRK2 until the groove is finally no longer present. In a third crankshaft angle range CRK3 the groove 25 has a constant position in the direction marked by the axis X. In a fourth crankshaft angle range CRK4 the groove has a changing position in relation to the axis X. In the fourth crankshaft angle range CRK a pin 24 engaged in the groove 25 causes a corresponding axial displacement of the actuator element 20 in the direction of the axis X.

The cylinder head 3 also has an injection valve 28 and a spark plug 29.

A controller 30 is also provided, to which sensors are assigned, which detect different measured variables and respectively determine the measured value of the measured variable. The controller, which can also be referred to as a device for controlling the internal combustion engine, determines manipulated variables as a function of at least one measured variable, said manipulated variables then being converted to one or more control signals to control actuator bodies.

The sensors are a pedal position sensor 38, which detects the position of an accelerator pedal 39, an air mass sensor 32, which detects an air mass flow, a temperature sensor 33, which detects an intake air temperature, an intake pipe pressure sensor 34, which detects the intake pipe pressure, a crankshaft angle sensor 35, which detects a crankshaft angle CRK, to which a speed N is then assigned, a camshaft angle sensor 37, which detects a camshaft angle NW. Any sub-set of the said sensors or even additional sensors can be present, depending on the embodiment of the invention.

The actuator bodies are for example the throttle valve 5 the gas inlet and gas outlet valves 13, 14, the injection valve 28, the spark plug 29 or even the actuator element 20.

As well as the cylinder Z1, the internal combustion engine preferably also has further cylinders Z2, Z3, Z4, to which corresponding sensors and actuator bodies are assigned and which are activated correspondingly.

The controller 30 is preferably one assembly unit. It can however also be made up of individual assembly units that are physically separate from each other. The controller 30 comprises a first unit 40, which is configured to identify whether switching of the valve lift VL has taken place based on an induced voltage at the inductive actuator drive 23, which is characteristic of the switching process. The controller 30 also comprises a second unit 41, which is configured to activate at least one actuator body, for example the injection valve 28 and/or the spark plug 29, as a function of whether switching of the valve lift VL has been identified in the first unit 40.

Figure 4:
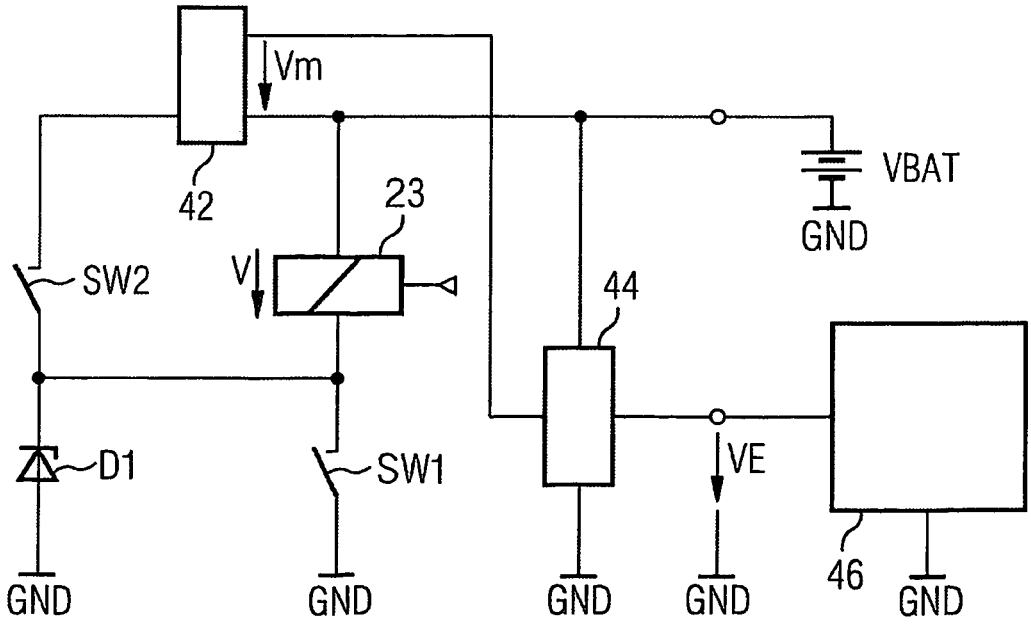
FIG. 4 shows a block circuit diagram of parts of the controller.

The first unit 40 comprises a measuring unit 42, which is configured to measure a voltage drop V over the inductive actuator drive 23 in relation to a supply potential VBAT (FIG. 4) of a voltage supply, preferably an on-board voltage supply system in a motor vehicle. The inductive actuator drive 23 is coupled on the one hand to the supply potential VBAT. On the other hand the inductive actuator drive 23 can be coupled in an electrically conductive manner to the reference potential GND, as a function of the position of a first switch SW1 and the inductive actuator drive 23 is similarly coupled in an electrically conductive manner to a Zener diode D1. A second switch SW2 is also provided, as a function of whose position the measuring unit 42 can be connected parallel to the inductive actuator drive 23.

To measure the voltage drop V over the inductive actuator drive 23, the first switch SW1 is controlled into its open position and the second switch SW2 is controlled into its closed position. The measuring unit 42 then detects the voltage drop V over the inductive actuator drive 23 and generates a corresponding measurement signal VM at its output, via which it is coupled in an electrically conductive manner to a conversion unit 44. The measuring unit 42 thus detects the voltage drop V over the inductive actuator drive 23 in relation to the supply potential VBAT.

The conversion unit 44 converts the measurement signal VM of the measuring unit 42 into an output signal VE, which is related to the reference potential GND. This can be done for example by means of a current balancing circuit. At the same time the measurement signal VM of the measuring unit 42 is preferably amplified in the conversion unit 44. The output signal VE of the conversion unit 44 is then an input signal for the evaluation unit 46. The output signal VE of the conversion unit 44 is preferably fed to an analog/digital converter input of the evaluation unit 46 and converted there from analog to digital.

Figure 5:
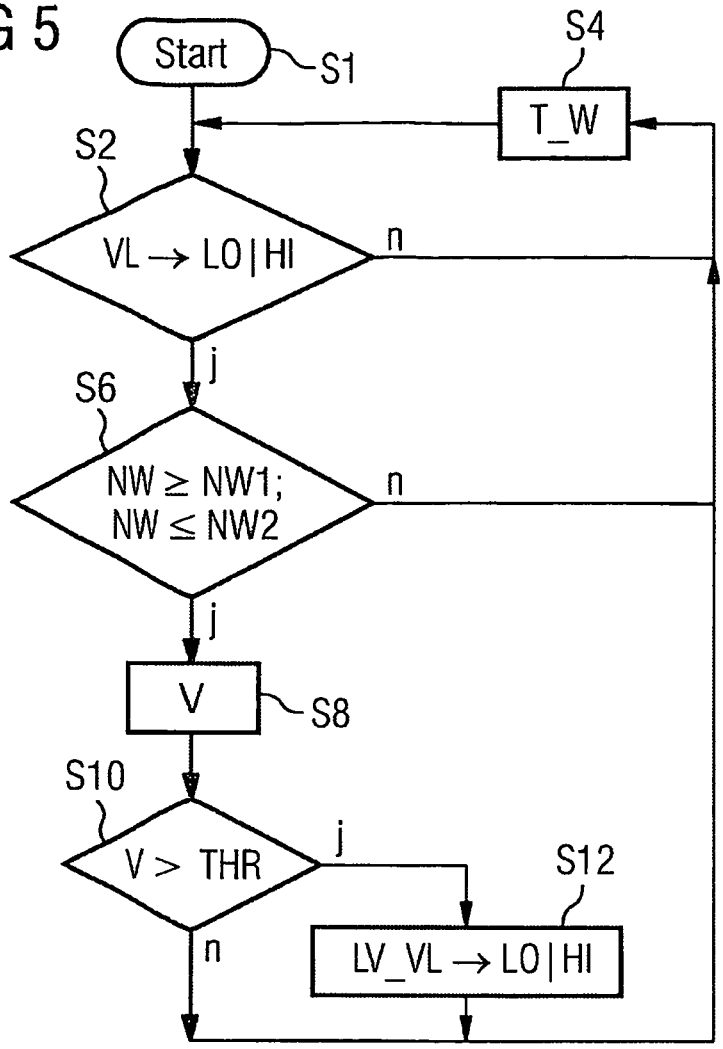
FIG. 5 shows a flow diagram of a program, operating in an evaluation unit.

The correspondingly digitized output signal VE of the conversion unit 44 is then further processed in the evaluation unit 46 and then optionally rescaled there into the voltage drop V over the inductive actuator drive 43. During operation of the internal combustion engine a program is run in the evaluation unit 46, said program being described in more detail below with reference to the flow diagram in FIG. 5.

The program is started in a step S1, in which variables can optionally be initialized. The start of the program preferably takes place close in time to the starting up of the internal combustion engine. In a step S2 it is verified whether there is a requirement to switch the valve lift VL from a low valve lift LO to a high valve lift HI or vice-versa. The actual switching process is controlled by a function in the controller 30, which activates the inductive actuator drive 23 during the first crankshaft angle range CRK1 by corresponding activation of the switch SW1, such that the pin 24 moves into the groove 25. If the condition of step S2 is not satisfied, processing continues in a step S4, in which the program is halted for a predetermined waiting period T_W, before the condition of step S2 is verified again.

If however the condition of step S2 is satisfied, it is verified in a step S6 whether the current camshaft angle NW is greater than a first camshaft angle NW1 and at the same time smaller than a second camshaft angle NW2. Alternatively the presence of a corresponding crankshaft angle CRK can be verified here, taking the current phase angle between the crankshaft 9 and the camshaft 18 into account correspondingly. The first and second camshaft angles NW1, NW2 are selected such that the camshaft angle range in between corresponds roughly to the second crankshaft angle range CRK2, in which the depth of the groove 25 decreases to zero.

If the condition of step S6 is not satisfied, processing continues in step S4. If however the condition of step S6 is satisfied, in a step S8 the current voltage drop V over the inductive actuator drive 23 is read in. This can be done for example by controlling the switch SW2 into its closed position at this time and at the same time ensuring that the switch SW1 is in its open position. The measuring unit 42 then generates its measurement signal VM, which in turn is converted in the conversion unit 44 into the output signal VE and then in turn read in in the evaluation unit 46. Alternatively the measuring unit 42 can however be configured to buffer a measurement signal VM it has detected. The evaluation unit 46 can then detect the output signal VE irrespective of the time of detection of the measurement signal VM. It is however important that the measuring unit 42 detects the measurement signal VM within the camshaft angle range, which is bounded by the first camshaft angle NW1 and the second camshaft angle NW2.

It is then verified in a step S10 whether the voltage drop V over the inductive actuator drive 23 is greater than a predetermined threshold value THR. The predetermined threshold value THR is preferably determined by experiment or simulation, such that when the voltage drop V at the inductive actuator drive 23 exceeds the threshold value THR, this is characteristic of an induced voltage, which is characteristic of the pin 24 being pressed back out of the groove 25 due to the decrease in the depth of the groove 25.

If the condition of step S10 is not satisfied, processing continues directly in step S4. If however the condition of step S10 is satisfied, in a step S12 a logical variable LV_VL is assigned a low valve lift LO or a high valve lift HI according to the requirements specified in step S2 for switching the valve lift VL. Processing then continues in a similar manner in step S4.

Figure 6:
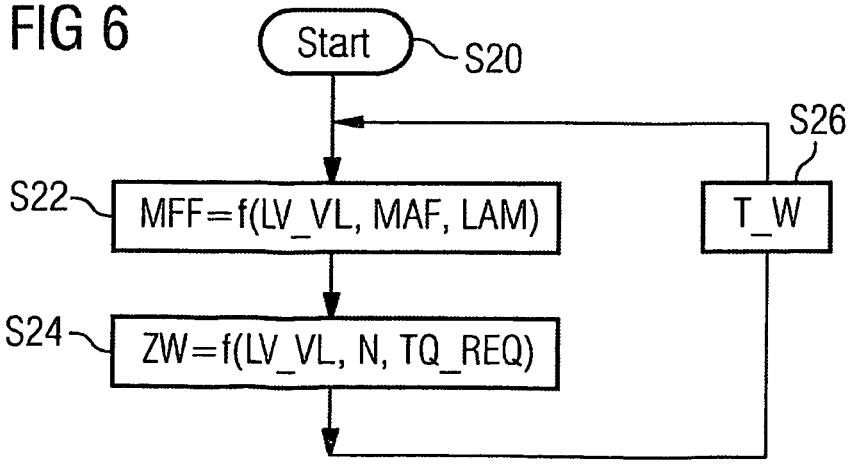
FIG. 6 shows a flow diagram of a program operating in a second unit and FIG. 7 shows a second block circuit diagram of parts of the controller.

In the second unit 41 during operation of the internal combustion engine a program is processed, which is described in more detail below with reference to FIG. 6. The program is started in a step S20, in which variables are optionally initialized. In a step S22 a fuel mass to be injected MFF is determined as a function of an air mass flow MAF into the cylinder Z1, an air/fuel ratio in the cylinder Z1 LAM and as a function of the value of the logical variable LV_VL. A control signal to activate the injection valve 28 is then generated as a function of the fuel mass to be injected MFF.

The waiting time T_W in step S4 of the program, which is processed in the first unit 40, is preferably selected such that it can be ensured that the logical variable LV_VL is always updated so promptly in step S112 that the fuel mass to be injected MFF always has the correct values of the actual valve lift for the current operating cycle of the cylinder Z1 in step S22 to determine the fuel mass MFF.

In a step S24 an ignition angle ZW is then determined as a function of the speed N, a required torque TQ_RQ, which is to be set by the internal combustion engine, and the value of the logical variable LV_VL. The required torque TQ_RQ is determined as a function of the detected accelerator pedal position and optionally further variables or torque requirements. The program is then halted in a step S26 for the predetermined waiting time T_W, which can however be different from the waiting time in step S4.

Figure 7:
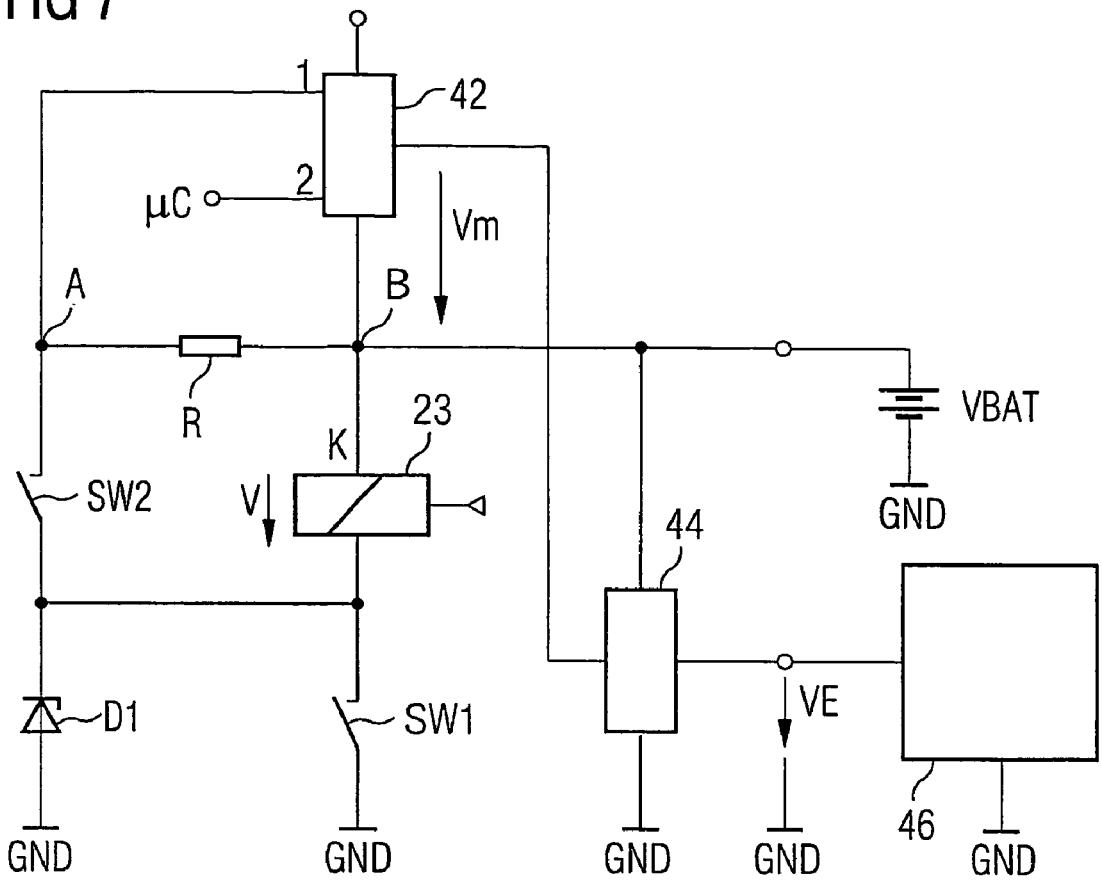

FIG. 7 shows a further alternative block circuit diagram of parts of the controller 30. R refers to a resistor, which is preferably designed to be high-resistance and is provided to detect the voltage drop V over the inductive actuator drive by means of the measuring unit 42. Further inductive actuator drives, for example those assigned to different cylinders Z2 to Z4, can also be connected in an electrically conductive manner at the node points A and B. If corresponding further second switches SW2 are then provided, the measuring unit 42 can also be used to detect the respective voltage drop over the further inductive actuator drives.

The Zener diode D2 ensures that the measurement signal VM of the measuring unit can be detected very quickly after the first switch SW1 is opened.

With the controller 30 it is thus possible to identify any malfunction of the actuator element 20 and in particular the inductive actuator drive 23 due to an electrical or mechanical defect or incorrectly timed activation in a very simple manner.

The invention claimed is:

1. A method for controlling an internal combustion engine having a camshaft and an intake pipe connected to a gas inlet valve arranged at an inlet of a cylinder of the engine, comprising:

associating a plurality of cam profiles with the gas inlet valve;

actuating a gas inlet valve drive that acts on the gas inlet valves;

actuating an actuator configured to select a specific cam profile from the plurality of cam profiles to act on the gas inlet valve drive where a valve lift of the gas inlet valve is adjustable based on the specific cam profile selected;

inducing a voltage in an inductive actuator drive connected to the actuator and configured to induce a voltage signal based on a switching of cam profiles;

determining if switching of the cam profile has occurred based on the induced voltage in the inductive actuator drive; and activating an actuator body as a function of whether switching of the cam profile has been determined.

2. The method as claimed in claim 1, wherein the engine comprises a plurality of gas inlet valves where each gas inlet valve is operatively associated with a portion of the cam profiles.

3. The method as claimed in claim 1, further comprising verifying whether the induced voltage in the inductive actuator drive occurs within a predetermined camshaft angle range.

4. The method as claimed in claim 1, wherein the gas inlet drive actuates the gas inlet valves.

5. A device for controlling an internal combustion engine having a camshaft and an intake pipe connected to a gas inlet valve arranged at an inlet of a cylinder of the engine, comprising:

a plurality of cam profiles arranged on the camshaft;

a plurality of gas inlet valves each gas inlet valve operatively associated with a portion of the plurality of camshaft profiles;

a gas inlet valve drive that actuates the gas inlet valves;

an actuator configured to select a specific cam profile from the plurality of cam profiles to act on the gas inlet valve drive where a valve lift of the gas inlet valve is adjustable based on the specific cam profile selected;

an inductive actuator drive connected to the actuator and configured to induce a voltage signal based on a switching of cam profiles;

a first control unit connected to the inductive actuator drive configured to identify if switching of the cam profile has occurred based on the induced voltage in the inductive actuator drive; and a second control unit configured to activate a further actuator body as a function of whether switching of the cam profile has been identified in the first control unit.

6. The device as claimed in claim 5, wherein the first control unit is configured to verify whether the induced voltage in the inductive actuator drive drops within a predetermined camshaft angle range.

7. The device as claimed in claim 5, wherein the first control unit includes a measuring unit configured to measure a voltage drop over the inductive actuator drive relative to a supply potential of the inductive actuator drive.

8. The device as claimed in claim 7, wherein the first control unit includes a conversion unit configured to convert the voltage drop over the inductive actuator drive to a corresponding voltage drop relative to a reference potential of an evaluation unit.

9. The device as claimed in claim 8, wherein the measuring unit includes a resistor which can be connected parallel to the inductive actuator drive by a switch.

10. The device as claimed in claim 9, wherein the measuring unit is configured to detect the voltage drop over a plurality of inductive actuator drives.

11. The device as claimed in claim 10, wherein the measuring unit includes a buffer for the detected voltage drop.

12. The device as claimed in claim 5, wherein the actuator body activated by the second control unit is selected from the group consisting of: an injection valve, a throttle valve, a gas inlet valve, a gas outlet valve, a spark plug and the actuator element.

13. A system for controlling an internal combustion engine having a camshaft with a plurality of cam profiles and an intake pipe connected to a gas inlet valve arranged at an inlet of a cylinder of the engine, comprising:

a plurality of gas inlet valves, each gas inlet valve operatively associated with a portion of the plurality of camshaft profiles;

a gas inlet valve drive that actuates the gas inlet valves;

an actuator configured to select a specific cam profile from the plurality of cam profiles to act on the gas inlet valve drive where a valve lift of the gas inlet valve is adjustable based on the specific cam profile selected;

an inductive actuator drive connected to the actuator and configured to induce a voltage signal based on a switching of cam profiles;

a first control unit in communication with the inductive actuator drive configured to measure a voltage drop over the inductive actuator drive relative to a supply potential of the inductive actuator drive to determine whether switching of the cam profile has occurred within a predetermined cam shaft angle range based on the induced voltage in the inductive actuator drive; and a second control unit configured to activate an actuator body based on whether the first unit has identified the cam profile as having been switched.

14. The system as claimed in claim 13, wherein the first control unit includes a measuring unit comprising a resistor which can be connected parallel to the inductive actuator drive by a switch.

15. The system as claimed in claim 14, wherein the measuring unit comprises a buffer for the detected voltage drop.

16. The system as claimed in claim 15, wherein the measuring unit is configured to detect the voltage drop over a plurality of inductive actuator drives.

17. The system as claimed in claim 13, wherein the actuator body actuated by the second control unit is selected from the group consisting of: an injection valve, a throttle valve, a gas inlet valve, a gas outlet valve, a spark plug and the actuator element.

* * * * *